US005634875A

United States Patent [19]

Fisk et al.

[11] Patent Number: 5,634,875

[45] Date of Patent: Jun. 3, 1997

[54] FOLDING MACHINE

[75] Inventors: Dwight R. Fisk, Sturgeon Bay; David A. Schmidt, Green Bay, both of Wis.

[73] Assignee: Elsner Engineering Works, Inc., Hanover, Pa.

[21] Appl. No.: 161,775

[22] Filed: Dec. 8, 1993

[51] Int. Cl.[6] ..... B65H 45/04; B65H 45/12

[52] U.S. Cl. ..... 493/422; 493/436; 493/461

[58] Field of Search ..... 493/416–419, 493/422, 424, 436, 442, 443, 445, 458, 460, 461

[56] References Cited

U.S. PATENT DOCUMENTS

| | | | |
|---|---|---|---|
| 1,870,544 | 8/1932 | Wood . | |
| 1,969,480 | 8/1934 | Shipley | 270/50 |
| 1,970,931 | 8/1934 | Crafts | 270/6 |
| 2,019,658 | 11/1935 | Grafts | 270/6 |
| 2,815,946 | 12/1957 | Cran | 270/68 |
| 2,857,827 | 10/1958 | Labombarde | 93/49 |
| 2,861,801 | 11/1958 | Cran | 270/68 |
| 2,985,449 | 5/1961 | Dietrich | 270/50 |
| 3,079,143 | 2/1963 | Jensen | 493/419 |
| 3,094,321 | 6/1963 | Kamberg | 270/68 |
| 3,260,518 | 7/1966 | Kamberg et al. | 270/62 |
| 3,476,379 | 11/1969 | Weir | 270/80 |
| 3,485,491 | 12/1969 | Weir | 270/68 |
| 3,517,919 | 6/1970 | Flygare | 493/419 |
| 3,572,688 | 3/1971 | Mazzolla | 270/68 |
| 3,706,450 | 12/1972 | Gerstenberger | 493/435 |
| 3,744,785 | 7/1973 | Grantham | 270/45 |
| 3,773,315 | 11/1973 | Tsien | 270/69 |
| 3,797,820 | 3/1974 | McDermott | 270/69 |
| 3,918,698 | 11/1975 | Coast | 270/69 |
| 3,927,875 | 12/1975 | Winnemoller et al. | 270/83 |
| 4,059,264 | 11/1977 | Vogel | 271/270 |
| 4,061,327 | 12/1977 | Blessing | 370/78 |
| 4,248,414 | 2/1981 | Rovin | 493/416 |
| 4,432,745 | 2/1984 | Eldridge | 493/10 |
| 4,573,959 | 3/1986 | Baccianti | 493/458 |
| 4,635,915 | 1/1987 | Sato | 270/49 E |
| 4,784,381 | 11/1988 | Prochut et al. | 271/268 |
| 4,819,926 | 4/1989 | Kosrow et al. | 270/45 |
| 4,840,609 | 6/1989 | Jone et al. | 493/28 |
| 5,079,867 | 1/1992 | Kober | 493/444 |
| 5,108,017 | 4/1992 | Adamski, Jr. et al. | 223/37 |
| 5,197,722 | 3/1993 | Adamski, Jr. et al. | 270/32 |

FOREIGN PATENT DOCUMENTS 3617572 5/1986 Germany .

*Primary Examiner*—Jack W. Lavinder
*Attorney, Agent, or Firm*—Thomas Hooker, P.C.

[57] ABSTRACT

A folding machine includes a vacuum conveyor and a plurality of flip folders spaced along the length of the conveyor. A length of sheet material is fed downstream along the conveyor to position the lead end of the sheet in clamp members at a first flip folder. The end is clamped and rotated downstream and up above the remainder of the sheet which is continuously fed down the conveyor. The clamps are released to allow the lead end to fall over the trailing edge of the sheet, thereby completing a first fold which reduces the length of the sheet 50 percent. Successive lead ends of the sheet are folded by second and third flip folders to reduce the length of the sheet to ⅛ the length of the original sheet and increase the thickness of the sheet to eight plies. The final folded bundle is fed to a tuck folder which further reduces the length of the package 50 percent forming a folded package 1/16 the length of the original sheet and having 16 plies.

45 Claims, 6 Drawing Sheets

FOLDING MACHINE

FIELD OF THE INVENTION

The invention relates to machines for folding lengths of flexible or relaxed sheet material, such as paper, a paper-plastic composite or plastic sheeting, into folded multi-layer packages and to methods of folding sheet materials into packages.

DESCRIPTION OF THE PRIOR ART

Prior folding machines move lengths of sheet material downstream along conveyors, lift the lead ends of the material above the conveyors and hold the lead ends above the conveyors while the remainder of the sheet is moved under the held end, following which the end is released to form a cross fold which reduces the length of the material by 50 percent. In this type of folder, a tool is used to lift the lead end of the material from the conveyor vertically above the conveyor to allow the remainder of the material to move downstream under the held end and form a cross fold reducing the length of the material. In one machine, the lead end is lifted from the conveyor by a member which extends up through the conveyor to lift the end and position it in a holder above the conveyor. The lifting member is then withdrawn to permit the remainder of the material to under the held end. In another folder, the lead end is lifted directly above the conveyor by a tool located above the conveyor so that, with further downstream movement of the sheet, the lead end is reverse bent 180 degrees prior to being released at the completion of the fold. These machines operate slowly and may undesirably deform the folded material.

SUMMARY OF THE INVENTION

The invention is a folding machine and method which rapidly and reliably cross folds lengths of sheet material fed to the machine a number of times to greatly reduce the length of the material and form a compact multi-layer folded package without injury to the sheet.

The machine includes a vacuum conveyor and a plurality of flip folders spaced along the length of the conveyor. Each flip folder receives the end of a length of sheet material, clamps the end in place and then rotates the end downstream and up above the conveyor so that downstream movement of the conveyor moves the remainder of the sheet under the held lead end. The end is released to fall on the trailing end of the sheet, thereby completing a flip fold which reduces the length of the sheet segment by 50 percent. Rollers and guides are provided to assure that the folded lead ends of lengths of sheet material are reduced in height sufficiently to be fed into a downstream flip folder or tuck folder.

A tuck folder is located downstream from the vacuum conveyor and tuck folds the relatively thick folded package of sheet material discharged from the vacuum conveyor. This package has a large number of folded layers and is not sufficiently flexible to permit further cross folding using a flip folder.

In a folding machine which includes three flip folders spaced along a vacuum conveyor and a single tuck folder, a length of flexible sheet material is rapidly folded four times to reduce the length of the material to 1/16 the original length and increase the thickness of the material to 16 plies. In a machine sufficiently large to receive ten foot lengths of sheet material, folding may occur at a high rate of 25 to 30 sheets per minute.

Other objects and features of the invention will become apparent as the description proceeds, especially when taken in conjunction with the accompanying drawings illustrating the invention, of which there are six sheets and one embodiment.

DESCRIPTION OF THE PREFERRED EMBODIMENT

Figure 1:
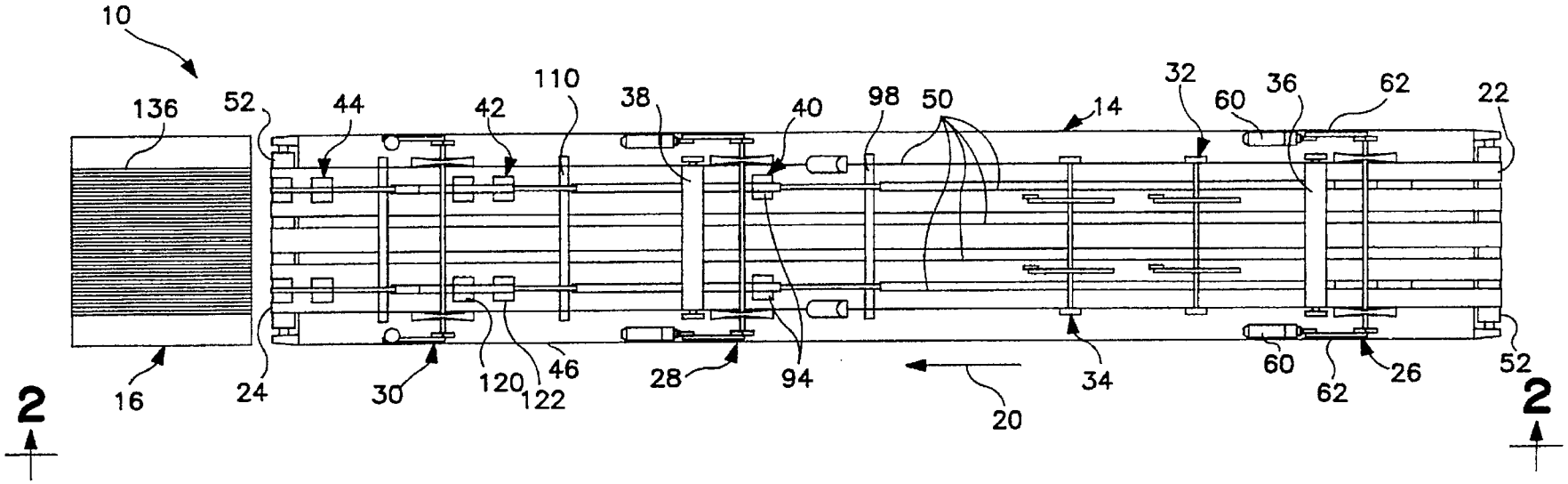
FIG. 1 is a top view of the folding machine with elements partially broken away.
Figure 2:
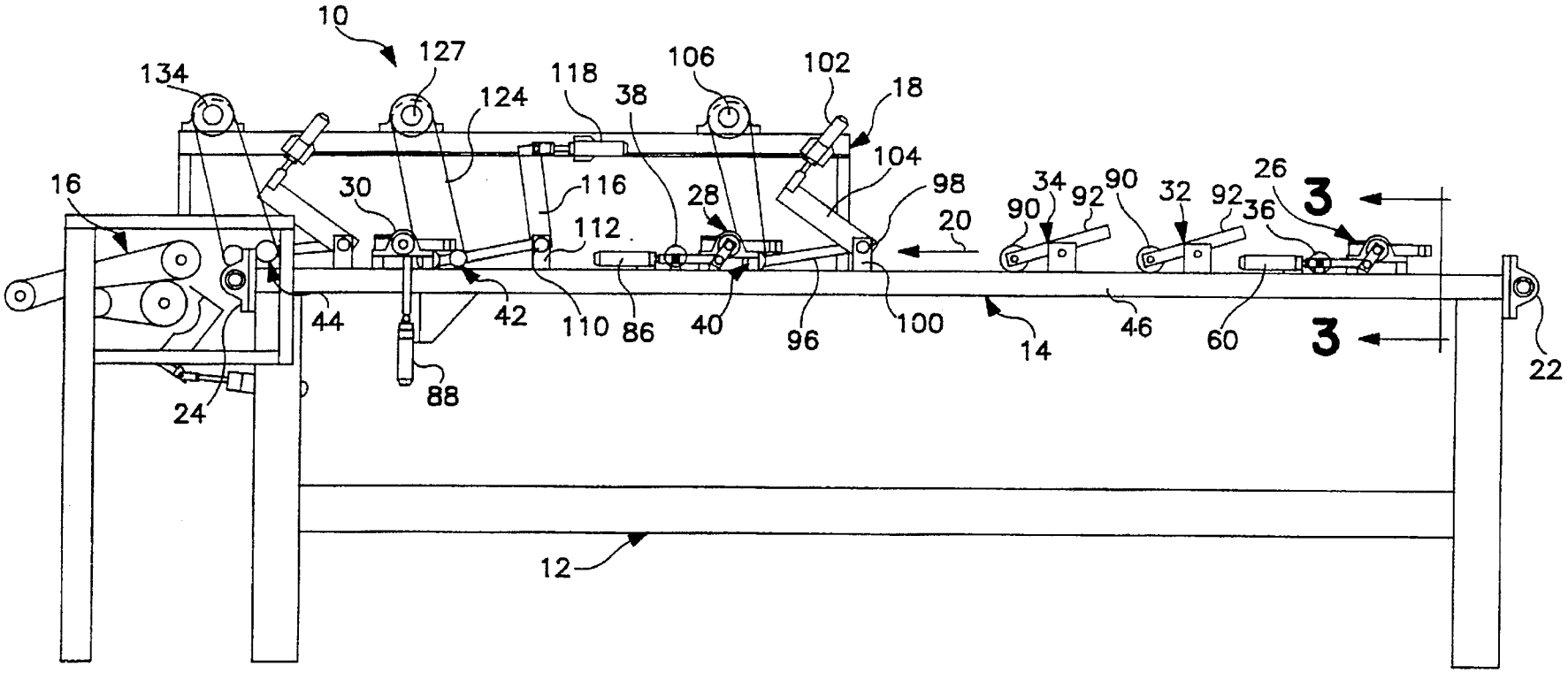
FIG. 2 is a side view of the folding machine taken along line 2—2 of FIG. 1.

Folding machine 10 includes a support frame 12 with an elongate vacuum conveyor 14 extending along the top of the frame and a tuck folder 16 located on the downstream end of the conveyor. A drive support 18 is located above the tuck folder and the downstream end of conveyor 14. The support runs of conveyor 14 move downstream in the direction of arrow 20 from upstream end 22 to downstream end 24.

First, second and third flip folders 26, 28 and 30 are spaced along vacuum conveyor 14 with the distance between folders 26 and 28 being approximately twice the distance between folders 28 and 30. Gravity hold downs 32 and 34 are located between flip folders 26 and 28. Control roller 36 extends across the width of the conveyor 14 immediately downstream from flip folder 26 and control roller 38 extends across the width of the conveyor 14 immediately downstream from flip folder 28. Fold guide 40 is located immediately upstream of flip folder 28. Fold guide 42 is located immediately upstream of flip folder 30 and fold guide 44 is located at the downstream end 24 of conveyor 14 upstream of the tuck folder 16.

Figure 3:
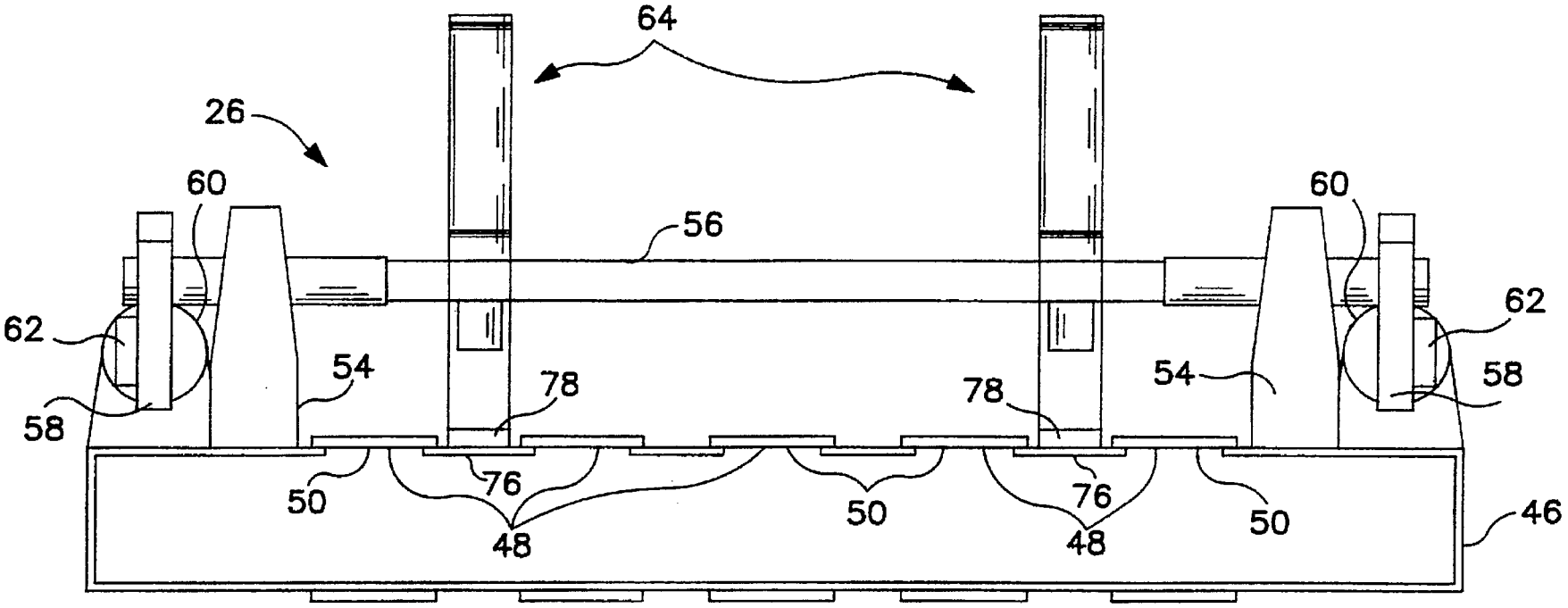
FIG. 3 is a sectional view taken along line 3—3 of FIG. 2.

Vacuum conveyor 14 includes a hollow metal vacuum box 46 extending the length of the conveyor and defining a plurality of elongate slots 48 formed in the top of the box and extending along the length of the box. The interior of the vacuum box 46 is connected to a vacuum source (not illustrated) to reduce the pressure in the box. A plurality of apertured vacuum belts 50 are fitted on the box between rollers 52 on the upstream and downstream ends of the box with the upper runs of the belts spanning the slots 48 as shown in FIG. 3 so that the reduced pressure within the box flows air through the belts, into the box and to the vacuum source. Sheet material placed on the upper runs of the belts is vacuum held on the belts and is moved along the conveyor with movement of the belts. A suitable belt drive (not illustrated) rotates one or both of the rollers 52 to move the upper runs of the belts downstream in the direction of arrow 20. As illustrated in FIG. 3, the upper runs of belts 50 are spaced apart across the width of the vacuum box 46 by strip 76.

Figure 4:
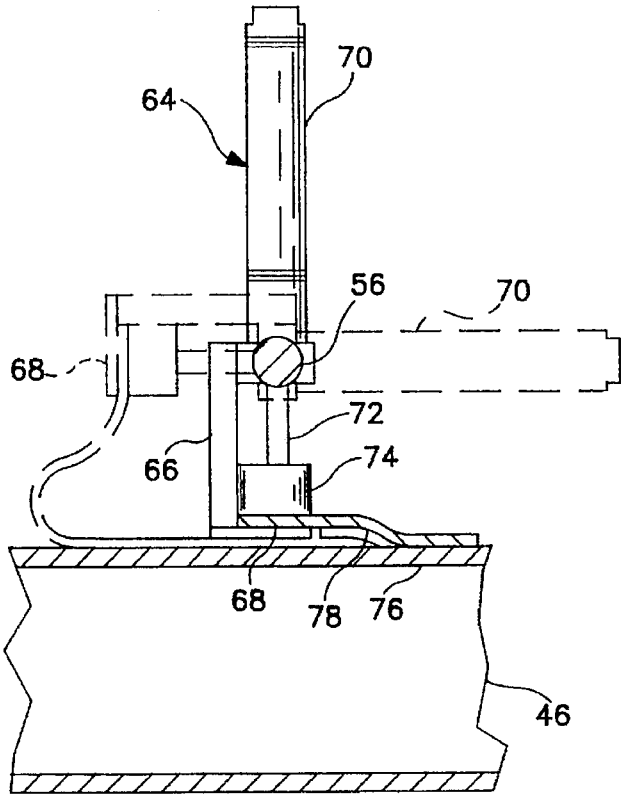
FIG. 4 is a side view illustrating a first flip folder.

First flip folder 26 is illustrated in FIGS. 3 and 4 and includes a pair of vertical support members 54 located on the top of box 46 to either side of the vacuum belts 50, a cross shaft 56 journaled in the support members and extending across the belts a distance above the belts with ends extending outwardly of the support members. Radial arms 58 are secured to the outer ends of the cross shaft. Drive air cylinders 60 are mounted on the vacuum box on the downstream side of the support members. Links 62 connect the piston rods of air cylinders 60 to arms 58 such that extension and retraction of the cylinders rotates shaft 56 back and forth 90 degrees.

A pair of clamp members 64 are mounted on shaft 56 with each member located above the strip 76 between the outermost and adjacent outermost belts 50, as shown in FIG. 3. Each clamp member includes an L-shaped bracket 66 secured to cross shaft 56 having a foot 68 located a distance away and extending to one side of the cross shaft. Member 64 also includes an air cylinder 70 mounted on the cross shaft and having a piston rod 72 extending toward foot 68. The resilient friction clamp element 74 is secured on the free end of piston rod 72 such that extension of cylinder 70, as shown in FIG. 4 moves the clamp element against foot 68. The clamp element may be a rubber member fitted over the end of the piston rod.

Rotation of the cross shaft 56 rotates the clamp member 64 about the axis of the shaft between the vertical and horizontal positions shown in FIG. 4. When cylinders 60 are extended, the clamp members are in the vertical position with feet 68 located a short distance above metal strips 76 supporting the adjacent edges of the outer and next to outermost belts 50. Ramps 78 project upwardly from strip 76 immediately upstream of the feet 68 of both clamp members 64 when the members are in the vertical position. As shown in FIG. 4, the upper surface of the ramps is at the same level as the upper surface of feet 68 so that the edge of sheet material fed downstream along the vacuum conveyor is lifted up and over each of the feet 68 as illustrated.

Retraction of drive air cylinders 60 rotates shaft 56 and the clamp members from the vertical position to the horizontal position shown in dashed lines in FIG. 4 to rotate the feet 68 first downstream and then vertically above the conveyor 14 as illustrated.

Figure 5:
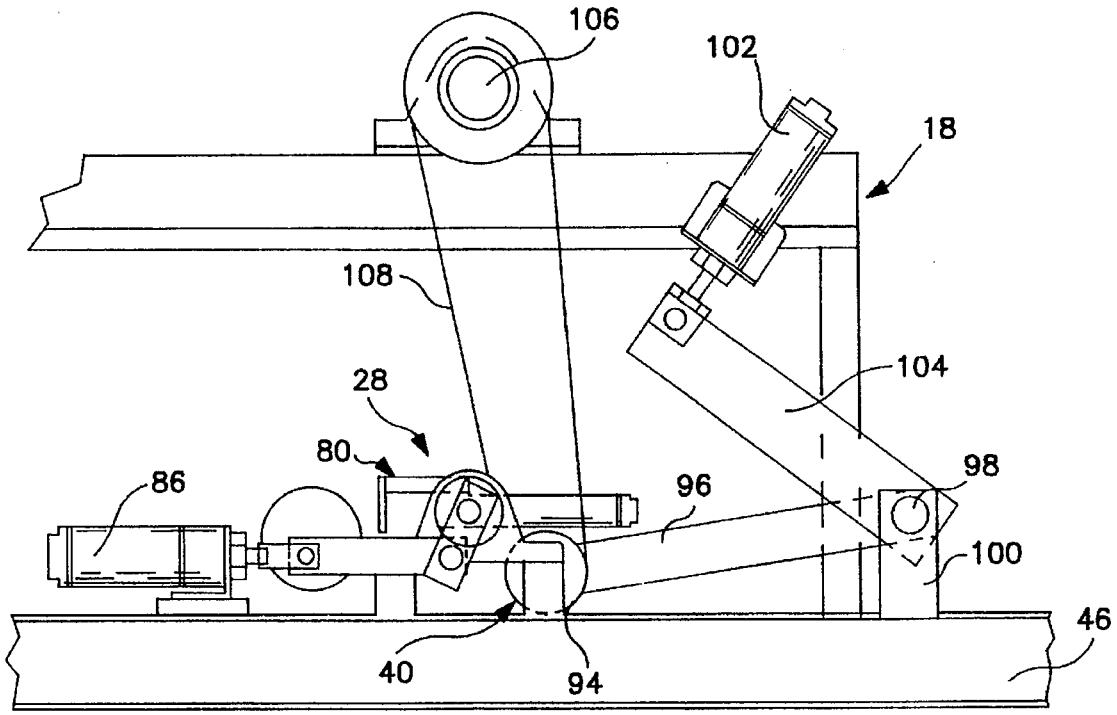
FIG. 5 is a side view illustrating a second flip folder.

The second flip folder 28 illustrated in FIG. 5 is like the first flip folder 26 and includes a pair of clamp members 80, like clamp members 64, support members, cross shaft, arms, air cylinders and links as used in the first flip folder 26. Lift ramps 82 extend upwardly from strips 76 immediately upstream of the feet of clamp members 80 when the clamp members are in the vertical position. See FIG. 7*d*.

The third flip folder 30 is similar to flip folders 26 and 28 and includes a pair of clamp members 84 like clamp members 64 and 80 together with support members, cross shaft, air cylinders and links as previously described. Drive air cylinders 60 for the first flip folder and drive air cylinders 86 for the second flip folder are mounted on the top of the vacuum box 46 as shown in FIG. 3. Drive air cylinders 88 for the third flip folder are mounted below the vacuum box and to one side of the cross shaft for the flip folder.

The disclosed flip folders 26, 28, and 30 each include a pair of drive air cylinders 60, 86 and 88. If desired, the folders may be rotated between the vertical and horizontal positions by a single, as opposed to two, drive air cylinders.

Figure 7A:
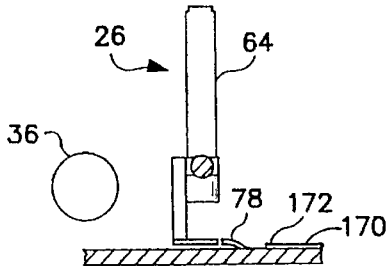
FIGS. 7*a* through 7*i* are side views illustrating operation of the first, second and third flip folders.
Figure 7B:
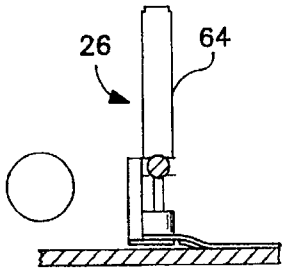
Figure 7C:
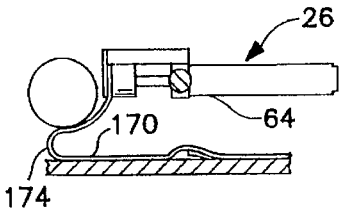

Gravity hold downs 32 and 34 each include a pair of rollers 90 mounted on the downstream end of pivot bars 92. Bars 92 are in turn rotatably mounted on cross shafts which are journalled in support members located to either side of the conveyor 14. The rollers 90 are located above two vacuum belts 50 and rest on sheet material being fed downstream along the vacuum conveyor to prevent lifting of the material above the belts. The bars 92 extend upstream beyond the cross shafts and may be depressed to lift the rollers 90 above the conveyor to facilitate clearing of jams, as required. Control roller 36 extends across the vacuum conveyor immediately downstream from the first flip folder 26 and is supported on a shaft journaled in supports extending upwardly from the vacuum box 46. As shown in FIGS. 7*a–c*, the roller 36 is located a distance above the conveyor to facilitate downstream feeding of the lead fold formed in the sheet material by the flip folder 26.

Figure 7D:
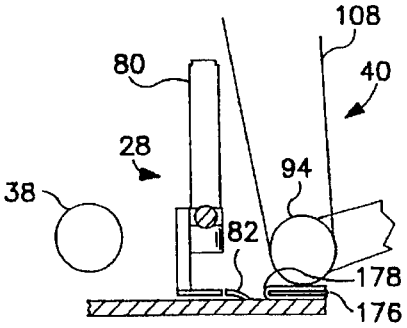
Figure 7E:
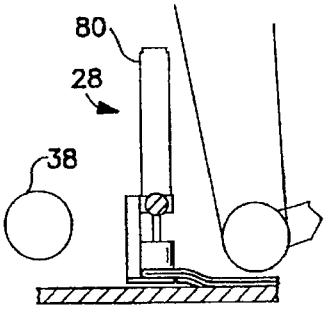
Figure 7F:
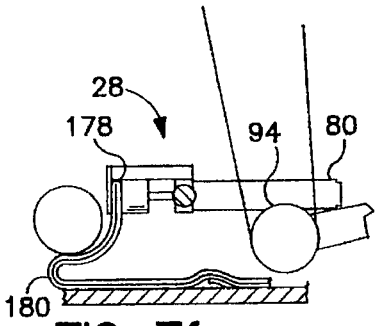

Control roller 38 is like roller 36 and extends across the vacuum conveyor 14 immediately downstream from the second flip folder 28 as shown in FIGS. 7*d–f*. The control roller 38 is located a distance further away from the top of the conveyor than roller 36 to facilitate movement of the lead fold in the sheet material formed by the second flip folder as shown in FIG. 7*f*.

Fold guide 40 includes a pair of side-by-side rollers 94 located upstream of the second flip folder clamp members 80 in alignment with the lift ramps 82. Rollers 94 are mounted on the downstream end of bars 96 which are in turn connected to a cross shaft 98 extending across the width of the conveyor 14 with ends journaled in support members 100 located to either side of the conveyor. The piston rod of air cylinder 102 mounted on support 18 is connected to arm 104 joining shaft 98 such that retraction of the air cylinder lifts the rollers 94 above the conveyor to permit clearing of jams as required. Belts 108 connect rollers 94 to a drive shaft 106 rotatably mounted on support 18. A suitable drive rotates the shaft to rotate the rollers 94 so that the lower surfaces of the rollers adjacent the conveyor 14 are rotated downstream at the same rate vacuum belts 50 are moved downstream. As shown in FIG. 7*d* the rollers 94 of fold guide 40 assure that the height of lead fold end of a sheet moved down the conveyor is less than the spacing between the foot and clamp element of clamp member 80 to assure that the lead end is moved freely into the space between the foot and element for engagement and folding as shown in FIGS. 7*e* and 7*f*.

Fold guide 42 is similar to guide 40 and includes a cross shaft 110 extending across the width of conveyor 14 having ends journaled in support members 112, a pair of pivot bars 114 mounted on the shaft and arm 116 mounted on the shaft and connected to the rod of air cylinder 118 on drive support 18. A lead power roller 120 and a trailing power roller 122 are mounted on the downstream end of each pivot bar 114 upstream of lift ramps 182. Rollers 120 and 122 are like rollers 94. Belts 124, like belts 108, are wrapped around rollers 120 and 122 and a pulley on drive shaft 127, mounted on support 18 like shaft 106. A suitable drive rotates shaft 127 to rotate rollers 120 and 122 so that the portions facing the belt move downstream at a circumferential speed equal to the speed at which the belts 50 move downstream.

Figure 7G:
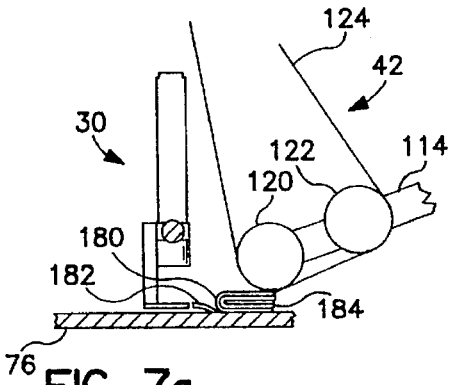
Figure 7H:
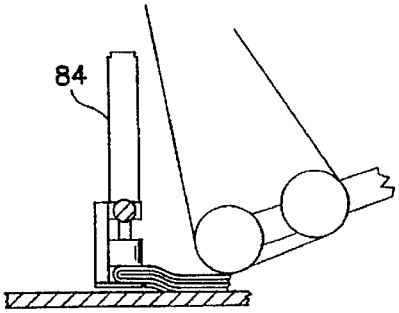
Figure 7I:
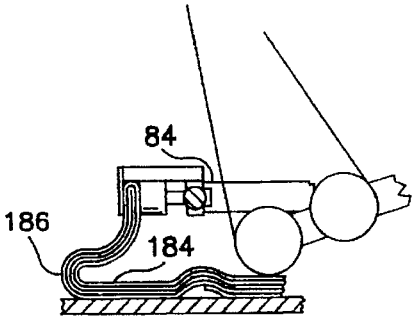

As shown in FIGS. 7*g* and 7*h*, the power rolls 120 and 122 receive a lead fold of a multi-folded sheet and reduce the height of the fold to less than the space between the feet and clamp elements of clamp members 84 to permit engagement and folding as shown in FIGS. 7*h* and 7*i*. Cylinder 118 may be retracted to raise the pivot bars and power rollers 120 and 122 above the conveyor to clear jams as required.

Figure 6A:
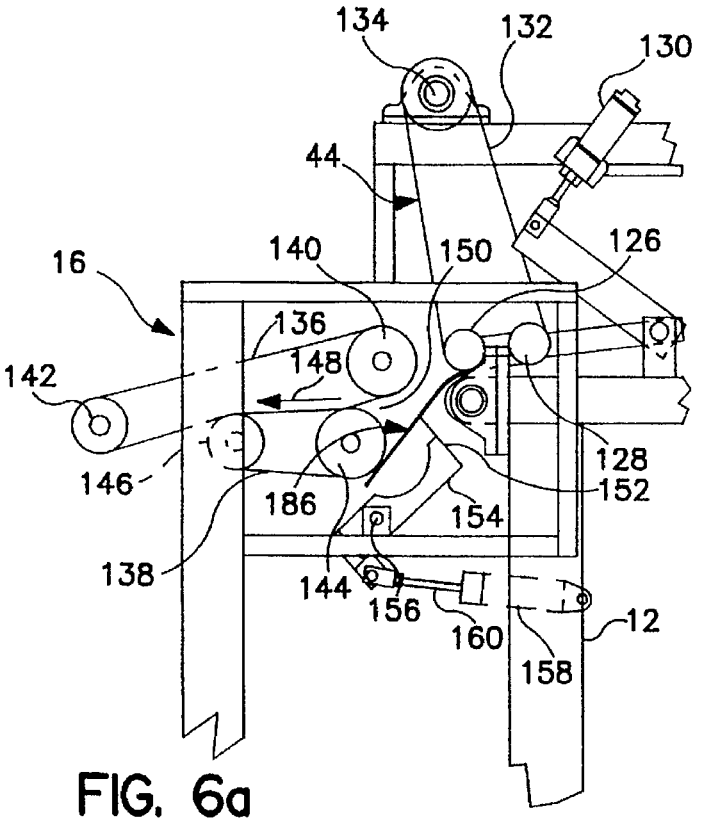
FIGS. 6*a* and 6*b* are side views illustrating the tuck folder.

Fold guide 44 is like guide 42 and includes two pairs of lead and trailing power rollers 126 and 128 located at the downstream end of vacuum conveyor 14 immediately upstream of the tuck folder 16. The rollers are mounted on the downstream ends of pivot bars connected to a cross shaft which is connected to air cylinder 130 by an arm on the shaft, as in guide 42. Belts 132 are wrapped around the rollers 126 and 128 and are connected to drive shaft 134 on support 18. A suitable drive rotates shaft 134 to rotate rollers 126 and 128 so that the surfaces facing the conveyor 14 move at a circumferential speed equal to the downstream speed of belts 50. As shown in FIG. 6*a*, guide 44 holds the folded product 186 fed to the tuck folder in place until actuation of the folder as shown in FIG. 6*b*.

Figure 6B:
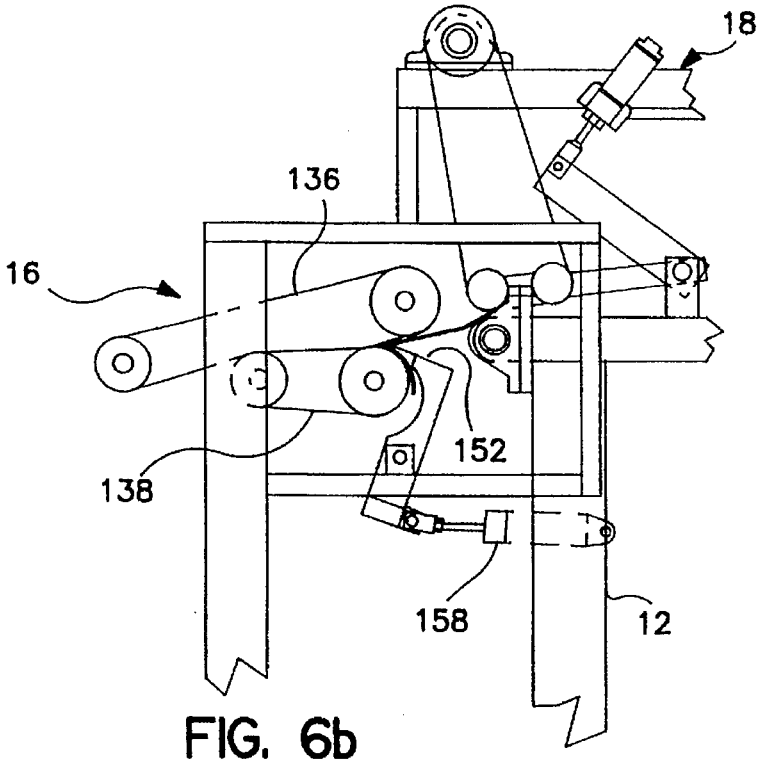

Tuck folder 16, as shown in FIGS. 6*a* and 6*b* includes two continuous conveyor belts 136 and 138. The upstream end of belt 136 is wrapped around cross roller 140 and the downstream end of the belt is wrapped around cross roller 142. Belt 138, located below belt 136, is wrapped around upstream roller 144 and downstream roller 146. Rollers 140, 142, 144, and 146 are mounted on frame 12. A suitable drive rotates the rollers to move the lower run of belt 136 and the upper run of belt 138 downstream in the direction of arrow 148. These runs engage each other with rollers 140 and 144 defining a tuck nip 150 at the upstream end of the belts.

A tucker blade 152 extends across the width of belts 136 and 138 across from nip 150 and is mounted on the upper end of pivot arms 154 which are rotatably mounted on cross shaft 156 supported on frame 12. Tucker air cylinder 158 is mounted on frame 12 and includes piston rod 160 connected to the end of an arm 154 away from the tucker blade so that retraction and extension of the cylinder moves the blade into and away from nip 150.

During operation of the folding machine the vacuum box 46 is maintained at reduced pressure to hold sheet material on belts 50, which are continuously moved downstream by a suitable drive. Likewise, a drive continuously rotates the drive shafts mounted on support 18 to rotate the drive rollers 94, 120, 122, 126 and 128 at a circumferential speed equal to the downstream speed of belts 50. During operation, the rollers are positioned as shown in the drawings.

Folding machine 10 includes an electrical control circuit with electric eye sensors located at appropriate locations along the vacuum conveyor and in the tuck folder to actuate the air cylinders in the flip folders and the tucker cylinder at appropriate times during the cycle of operation as hereinafter described. A drive continuously rotates tucker belts 136 and 138 to move the engaged runs downstream in the direction of arrow 148.

Folding machine 10 cross folds a length of foldable sheet material to form a bundle having a minimum length of 1/16 of the original length of the material. The flip folders 26, 28 and 30 have the capacity to reduce the length of the sheet material fed to the folders by 50 percent so that a sheet folded by all three folders has a final length equal to 1/8 of the length of the original sheet. The tuck folder further decreases the length of the material to form a folded bundle 1/16 the length of the original sheet. A tuck folder is required in order to reduce the length of the final folded bundle because the material is not sufficiently flexible to be folded further by flip folding.

Machine 10 may be used to cross fold lengths of single thickness sheet material fed to the upstream end of vacuum conveyor 14. Alternatively, the folding machine may be used to cross fold a length of sheet material which has been previously folded longitudinally with a reduced width equal to 1/4 the original width and including four individual layers. Such a longitudinally folded sheet includes a side edge defined by a longitudinal fold extending the length of the sheet. The hold-downs, control rollers and fold guides are useful in flattening this longitudinal fold to facilitate cross folding by the three flip folders 26, 28 and 30.

Folding machine 10 may be used to fold sheets of paper, paper-polyethylene composite sheets, synthetic nonwoven sheets or plastic sheets as required, provided that the sheets are sufficiently relaxed to facilitate flip folding.

FIGS. 7*a*–7*h* and FIGS. 6*a* and 6*b* illustrate operation of the folding machine in which a length 170 of appropriate sheet material is fed downstream along conveyor 14 past the flip folders and then through the tuck folder. The sheet has a lead end 172 shown in FIG. 7*a*. The reduced pressure in vacuum box 46 holds the sheet 170 on belts 50. Downstream movement of the belts moves the lead end 172 over lift ramps 78 upstream of the first flip folder 26 to lift the lead end at the two clamp members 64 above the conveyor and position the lead end over clamp feet 68 as shown in FIGS. 4 and 7*b*. Movement of the lead ends to this position is sensed and air cylinders 70 are extended to move clamp elements 74 down against the lead end and clamp the lead end between the elements and the feet. Drive air cylinders 60 are then extended to rapidly rotate cross shaft 56 and move the feet and the clamped lead end of the sheet first downstream with movement of the sheet downstream on the belts and then up through an angle of 90 degrees to the position of FIG. 7*c*. The lead end of the sheet 170 is stripped away from the vacuum belts and held stationary a distance above the vacuum belts. Continued downstream movement of the belts forms a lead fold 174 in the sheet. This fold moves downstream at 1/2 the speed at which the belts and the remaining portion of the sheet held on the belts move downstream. Contact roller 36 engages the held lead end of the sheet to locate the fold 174 closely adjacent to the top of the vacuum conveyor.

With continued downstream movement of the belts, the sheet 170 is cross folded in half at fold 174. When the fold 174 reaches the middle of the sheet, equidistant between the sheet ends, a sensor is actuated and cylinders 70 are retracted thereby releasing the held lead end of the sheet. Continued downstream movement of the belts moves the released end past the control roller which folds the end back down onto the half of the sheet which is held in place by vacuum on belts 50. In this way, flip folder 26 cross folds the sheet 170 to form a double thickness sheet 176, shown in FIG. 7*d*, having a length equal to 1/2 the length of sheet 170, two plies and a lead fold end 178.

After the trailing edge of the folded sheet passes the first flip folder 26, a sensor is actuated and cylinders 60 are extended to return the clamp members 64 to the vertical position for reception of the lead end of the next sheet fed to the folding machine.

The downstream movement of belts S0 moves the lead fold end 178 of half length sheet 176 downstream and under the rotating rollers 94. Rollers 94 assure that the height of the lead end is reduced sufficiently to permit free movement of the lead end up lift ramps 82 and onto the feet of the clamp members 80 of the second flip folder 28. Movement of lead fold end 178 into the clamp members is sensed, following which the clamp member cylinders are extended to clamp the lead end 178 against the feet and cylinders 86 are retracted to rotate the clamped end of the sheet 90 degrees, first in a downstream direction and then vertically above the belts to the position shown in FIG. 7*f*. This movement forms a two-thickness lead fold 180 under control roller 38. Continued downstream movement of the vacuum belts moves fold 180 downstream at half the speed at which the belts and remaining portion of the sheet held on the belts move downstream until the trailing end of the half-length sheet 176 moves under the clamped lead end. Movement of the sheet to this position is sensed and the clamp cylinders of members 80 are retracted allowing the lead end to fall down onto the conveyor over the trailing end, thereby completing the second cross fold and reducing the length of the folded sheet to ¼ the original length of sheet 170. The twice folded sheet has a four-ply thickness. As previously indicated, each ply may include four thicknesses of folded sheet material.

The four ply lead end fold 180 is moved downstream on belts 50 and under fold guide 42. Rollers 122 are spaced a greater distance away from the conveyor than rollers 120 to provide a lead end so that the fold first engages rollers 122 and the runs of belts 124 between the two rollers and is reduced in height to the spacing of rollers 120 above the conveyor. This spacing is less than the spacing between the feet and clamping elements of clamp members 84 to assure that the folded lead end 180 is fed up lift ramps 182 and into the clamp members.

When end 180 is positioned on the feet of members 84 a sensor is actuated to extend the clamp cylinders of the members and hold the lead ends in the members as shown in FIG. 7*h*. Cylinders 88 are then actuated to rotate the two clamp members 84 from the vertical position to the horizontal position shown in FIG. 7*i*, thereby moving the lead end 180 first downstream with the conveyor and then rotating the end up above the conveyor. Further downstream movement of the belts moves the ¼ length, four thickness sheet under the clamped end to complete the third flip fold and to reduce the length of the sheet to ⅛ the original length of sheet segment 170 and form new eight ply lead fold 186. The clamp cylinders are retracted to release the end 180 at the appropriate time so that the end falls over the trailing end of the sheet segment 184 and members are returned to the vertical position.

The short and relatively stiff eight thickness bundle 186 is fed downstream by belts and under fold guide 44. The guide flattens the lead end 186 and reduces the thickness of the bundle, as previously described in connection with the operation of power guide 42. The bundle is discharged from the downstream end of the conveyor and from guide 44 and falls down between rollers 140 and 144 and tucker blade 152, as shown in FIG. 6*a*. Movement to this position is sensed and cylinder 158 is retracted to rotate the tucker blade into nip 150, thereby bending the bundle 186 about the blade and bringing the outer sides of the partially folded bundle into contact with the downstream moving runs of belts 136 and 138. The belts frictionally engage the bundle, draw the bundle into the nip past the tucker blade and complete a fourth fold. The folded bundle is discharged from between the two belts onto a suitable take away conveyor or discharge receptacle, as required.

The folded bundle 186 has a length equal to 1/16 the length of the sheet 170 which was fed to the first flip folder 26, and a thickness of 16 plies.

Folders 26, 28 and 30 are spaced apart along the length of the vacuum conveyor 14 to permit folding of a length of sheet material by each of the folders with each folding operation being completed before the new folded lead end of the sheet material is moved downstream to the next folder. Thus, the distance between folders is equal to or greater than one-half the length of the sheet material fed to the upstream folder. The spacing may be greater than one-half the length of the material fed to the upstream folder when the material is folded to reduce its length by less than 50 percent. Material may be folded in this manner by suitably adjusting the time when the clamp members release the held lead end of the material.

As shown in FIG. 1, the spacing between the first and second folders 26 and 28 is at least twice the spacing between the second and third folders 28 and 30. The third folder 30 is spaced from the downstream conveyor end 24 a distance greater than one-half the distance between the second and third folders.

The drive air cylinders rotate flip folders 26, 28 and 30 through 90 degrees to rotate the clamp feet from a first position where the feet are located on the conveyor path and extend along the path to a second position located downstream from the first position and above the path where the feet extend toward the path. The feet need not be rotated through an angle of exactly 90 degrees but must be rotated through a sufficiently large angle to raise the lead end of the material a distance above the path to permit flip folding. The feet may be rotated through an angle of greater than 90 degrees to reduce the bend in the sheet material at the free end of the feet when in the second position. If desired, the clamp air cylinders 70, which extend an appreciable distance beyond the cross shafts and limit rotation, may be replaced by a short drives for moving the clamp elements thereby permitting rotation of the shafts and feet through an angle greater than 90 degrees.

The tuck folder 16, which forms the fourth and final fold, is not essential to operation of the folding machine. For instance, the vacuum conveyor and flip folders alone may be used to fold sheet material to form a bundle having a reduced length.

While we have illustrated and described a preferred embodiment of our invention, it is understood that this is capable of modification, and we therefore do not wish to be limited to the precise details set forth, but desire to avail ourselves of such changes and alterations as fall within the purview of the following claims.

What we claim as our invention is:

1. A machine for cross folding a length of sheet material having a lead end, the machine comprising:

a) a sheet material conveyor having an upstream end, a downstream end, a conveyor path extending between such ends, a belt on the path and a belt drive for moving the belt downstream along the path; and b) a rotatable first sheet material cross folder on the path of the conveyor, the folder including, i) a clamp member including a first foot, a first clamp element, a first drive for moving the clamp element toward the foot to clamp the lead end of a length of sheet material moving downstream along the conveyor path on the belt against the foot and for moving the clamp element away from the foot, the clamp member rotatable about an axis located above the path from a first position where the foot is located under the axis and on the conveyor path downstream along the path and then above the path to a second position located downstream from the first position and above the path, and ii) a rotary clamp member drive operable to rotate the clamp member about the axis from the first position to the second position so that the foot is initially moved downstream along the path with the belt and then is moved up and above the path to the second position.

2. A machine as in claim 1 including a lift ramp on the conveyor path located upstream of the foot when the clamp member is in the first position.

3. A machine as in claim 2 where the lift ramp is located to one side of the belt.

4. A machine as in claim 1 wherein the cross folder includes a second foot and a second clamp element, said first and second feet being spaced apart across the width of the path.

5. A machine as in claim 1 wherein said belt is perforated and including a vacuum source in communication with said belt so as to vacuum-hold sheet material on the belt during movement along the conveying path.

6. A machine as in claim 1 wherein said conveyor includes an elongate vacuum box extending along said path, a vacuum source connected to the box to withdraw air from the interior of the box, a plurality of perforated belts on top of the box having runs extending along said path and openings communicating the interior of the box with said perforated belts.

7. A machine as in claim 1 including a tuck folder located at the downstream end of the conveyor path.

8. A machine as in claim 7 wherein said tuck folder is adapted to receive a folded sheet material bundle discharged from the downstream end of the conveyor and wherein said tuck folder includes:

A) first folded sheet transfer means;

B) second folded sheet transfer means adjacent said first transfer means, said second transfer means for moving the folded sheet material bundle away from the conveyor in combination with the first transfer means, the first and second transfer means each having an upstream end near the conveyor downstream end, said upstream ends defining a tuck nip between said ends;

C) a tucker blade movable between a first position away from the tuck nip and a second position where the blade is located in the tuck nip; and D) a tucker blade drive operable to move the blade from the first position to the second position so that as the tucker blade moves to the second position, the blade engages the folded sheet material bundle and moves the bundle into engagement with said first and second transfer means.

9. A machine as in claim 1 wherein said clamp member drive rotates the foot through an angle from the first position to the second position of approximately 90 degrees.

10. A machine as in claim 1 wherein the clamp member drive rotates the foot through an angle from the first position to the second position greater than 90 degrees.

11. A machine for cross folding a length of sheet material having a lead end, the machine comprising:

a) a sheet material conveyor having an upstream end, a downstream end, a conveyor path extending between such ends, a belt on the path and a belt drive for moving the belt downstream along the path; and b) a first sheet material cross folder on the path of the conveyor, the folder including, i) a clamp member including a first foot, a first clamp element, a first drive for moving the clamp element toward the foot to clamp the lead end of a length of sheet material moving downstream along the conveyor path on the belt against the foot and for moving the clamp element away from the foot, the clamp member being movable between a first position where the foot is located on the conveyor path and a second position located downstream from the first position and above the path, and ii) a rotary clamp member drive operable to rotate the clamp member from the first position to the second position so that the foot is initially moved downstream along the path with the belt and then is moved up and above the path to the second position; and c) a second sheet material cross folder, said second folder being spaced along said path from said first folder.

12. A machine as in claim 11 including a third sheet material cross folder, said first folder being located upstream of the second folder and said second folder being located upstream of said third folder, and said second and third folders being spaced apart a distance approximately equal to one-half the spacing between said first and said second folders.

13. A machine as in claim 11 including a first control roller spaced a first distance above the conveyor path at a location along the conveyor path immediately downstream from the first cross folder said control roller for directing movement of a first lead fold in the sheet material formed by the first folder so that the folded lead end moves downstream at half the speed of the upstream portion of sheet material.

14. A machine as in claim 11 including a second control roller spaced a second distance above the conveyor path at a location along the conveyor path immediately downstream from the second cross folder for directing movement of a second lead fold in the sheet material formed by the second folder so that the folded lead end moves downstream at half the speed of the upstream portion of the sheet material.

15. A machine as in claim 14 wherein the second distance is greater than the first distance.

16. A machine as for cross folding a length of sheet material having a lead end, the machine comprising:

a) a sheet material conveyor having an upstream end, a downstream end, a conveyor path extending between such ends, a belt on the path and a belt drive for moving the belt downstream along the path;

b) a first sheet material cross folder on the path of the conveyor, the folder including, i) a clamp member including a first foot, a first clamp element, a first drive for moving the clamp element toward the foot to clamp the lead end of a length of sheet material moving downstream along the conveyor path on the belt against the foot and for moving the clamp element away from the foot, the clamp member being movable between a first position where the foot is located on the conveyor path and a second position located downstream from the first position and above the path, and ii) a rotary clamp member drive operable to rotate the clamp member from the first position to the second position so that the foot is initially moved downstream along the path with the belt and then is moved up and above the path to the second position; and c) a second sheet material cross folder located on the path of the conveyor downstream from the first sheet material cross folder and including a fold guide located immediately upstream of the second sheet material cross folder and spaced a distance above the belt for reducing the height of a lead fold formed in the sheet material as the lead fold is moved into the second sheet material cross folder.

17. A machine as in claim 16 including lift ramps located upstream of the feet of both the said sheet material cross folders when the cross folder clamp members are in the first position.

18. A machine as in claim 17 wherein said conveyor includes a vacuum belt and a vacuum source connected to the side of the belt facing away from the path.

19. A machine as in claim 16 wherein said fold guide includes a surface facing the path and a fold guide drive for moving such surface in a downstream direction.

20. A machine as in claim 19 wherein said fold guide comprises a roller and said fold guide drive rotates the roller to move the side facing the belt downstream at a circumferential speed equal to the downstream speed of the belt.

21. A machine as in claim 19 wherein said fold guide comprises a pair of rollers spaced longitudinally along the path with the roller remote from the cross folder being located further away from the path than the roller adjacent the cross folder, and including drive means for rotating both said rollers to move the sides facing the belt downstream at a circumferential speed equal to the downstream speed of the conveyor belt.

22. The method of folding a length of sheet material into a bundle comprising the steps of:

a) continuously feeding a length of sheet material having a lead end downstream along a path;

b) rotating the lead end of the sheet material downstream and then above the path to position the lead end at a location above the path;

c) holding the lead end in the location while feeding the material downstream along the path to form a new folded lead end of the sheet material;

d) releasing the held lead end of the sheet material from the location and lowering the lead end back onto the path to reduce the length of the sheet material and form two plies of sheet material;

e) feeding the shortened two-ply sheet material down the path; and f) repeating steps b, c, d and e to form a folded bundle having X plies and a length equal to 1/X times the initial length of the sheet material.

23. The method of claim 22 wherein step b) includes rotating the lead end of the strip material approximately 90 degrees above the path.

24. The method of claim 22 wherein step b) includes the step of rotating the lead end of the strip material through an angle greater than 90 degrees.

25. The method of claim 22 including the steps of:

g) actuating a tuck folder having a first transfer conveyor with an upstream end, a second transfer conveyor adjacent said first conveyor, said second transfer conveyor also having an upstream end, a tuck nip defined by the upstream ends of the conveyors and a tucker blade movable into and away from the tuck nip; and h) feeding the bundle into the tuck nip, moving the tucker blade into engagement with the bundle and moving the bundle into engagement with the transfer conveyors.

26. The method of claim 22 wherein the folded bundle has 16 plies and a length equal to 1/16 times the initial length of the sheet material.

27. The method of claim 22 wherein step b) includes gripping the lead end of the sheet material before rotating said lead end.

28. The method of claim 22 wherein each time step c) is repeated, the step includes moving the newly folded lead end below a control roller so that the folded lead end moves downstream at half the speed of the upstream portion of the sheet material.

29. The method of claim 22 wherein step b) includes feeding the lead end of the sheet material up a lift ramp before gripping the lead end.

30. The method of claim 22 wherein step a) includes feeding the sheet material under one or more gravity hold downs located on the path.

31. The method of claim 22 wherein each time step b) is repeated, the step includes moving a fold guide onto the folded sheet, compressing the folded sheet before gripping the sheet lead end.

32. A machine for cross folding a length of sheet material having a lead end, the machine comprising:

a) a sheet material conveyor having an upstream end, a downstream end, a conveyor path extending between such ends, a belt on the path and a belt drive for moving the belt downstream along the path; and b) a first sheet material cross folder on the path of the conveyor, the folder including, i) a clamp member including a first foot, a first clamp element, a first drive for moving the clamp element toward the foot to clamp the lead end of a length of sheet material moving downstream along the conveyor path on the belt against the foot and for moving the clamp element away from the foot, the clamp member being movable between a first position where the foot is located on the conveyor path and a second position located downstream from the first position and above the path, ii) a rotary clamp member drive operable to rotate the clamp member from the first position to the second position so that the foot is initially moved downstream along the path with the belt and then is moved up and above the path to the second position; and c) a tuck folder located at the downstream end of the conveyor path, said tuck folder adapted to receive a folded sheet material bundle discharged from the downstream end of the conveyor, said tuck folder including i) first folded sheet transfer means;

ii) second folded sheet transfer means adjacent said first transfer means, said second transfer means for moving the folded sheet material bundle away from the conveyor in combination with the first transfer means, the first and second transfer means each having an upstream end near the conveyor downstream end, said upstream ends defining a tuck nip between said ends;

iii) a tucker blade movable between a first position away from the tuck nip and a second position where the blade is located in the tuck nip; and iv) a tucker blade drive operable to move the blade from the first position to the second position so that as the tucker blade moves to the second position, the blade engages the folded sheet material bundle and moves the bundle into engagement with said first and second transfer means, v) said first folded sheet transfer means including a downstream end away from the upstream end, a first cross roller at the upstream end, a second cross roller at the downstream end, a continuous belt wrapped around the cross rollers with a lower belt run adjacent the second transfer means, and a first roller drive to rotate the cross rollers and move the lower belt run toward the downstream end of said first transfer means.

33. A machine as in claim 32 wherein said second sheet transfer means includes a downstream end away from the upstream end, a third cross roller at the upstream end, a fourth cross roller at the downstream end and a continuous belt wrapped around the rollers with an upper run adjacent the first transfer means and a second roller drive to rotate the cross rollers and move the upper belt run toward the downstream end of the second transfer means.

34. A machine as in claim 33 wherein the first cross roller and the third cross roller define the tuck nip.

35. A machine for cross folding a length of sheet material having a lead end, the machine comprising:

a) a sheet material conveyor having an upstream end, a downstream end, a conveyor path extending between such ends, a belt on the path and a belt drive for moving the belt downstream along the path;

b) a first sheet material cross folder on the path of the conveyor, the folder including, i) a clamp member including a first foot, a first clamp element, a first drive for moving the clamp element toward the foot to clamp the lead end of a length of sheet material moving downstream along the conveyor path on the belt against the foot and for moving the clamp element away from the foot, the clamp member being movable between a first position where the foot is located on the conveyor path and a second position located downstream from the first position and above the path, and ii) a rotary clamp member drive operable to rotate the clamp member from the first position to the second position so that the foot is initially moved downstream along the path with the belt and then is moved up and above the path to the second position; and c) a first gravity hold down located on the conveyor path, downstream from the first cross folder for maintaining the sheet material on the belt as the sheet material moves downstream.

36. A machine as in claim 35 which includes a second gravity hold down like the first gravity hold down, said second gravity hold down being spaced downstream from said first gravity hold down along the conveyor path.

37. A machine as in claim 36 including a gravity hold down frame and wherein said first and second gravity hold downs comprise a pivot bar supported by the frame, said bar having a first bar end adjacent the conveyor path and a hold down roller rotatably mounted on the bar at the first bar end and located on the belt, said roller adapted to engage the sheet material as it moves downstream.

38. A machine as in claim 36 which includes a fourth gravity hold down like the first gravity old down spaced from the second gravity hold down along the width of the conveyor path.

39. A machine as in claim 35 which includes a third gravity hold down like the first gravity hold down spaced from the first hold down along the width of the conveyor path.

40. A machine for cross folding a length of sheet material having a lead end, said machine comprising:

a) a frame;

b) a sheet material conveyor on the frame, said sheet material conveyor having an upstream end, a downstream end, a conveyor path between said ends, a belt on the path and a belt drive for moving the belt toward the downstream end along the path;

c) a first sheet material cross folder on the frame above the conveying path, the folder including:

i) a clamp support located above the conveyor path, ii) a clamp on the clamp support for clamping the lead end of a length of sheet material moving along the conveyor path toward the downstream end of the conveyor, the clamp being movable from a first position located under the support and on the conveying path downstream along the path and then above the path to a second position located downstream from the first position and above the conveyor path, and iii) a drive for moving the clamp from the first position downstream and then above and away from the conveyor path to the second position.

41. A machine as in claim 40 wherein the first sheet material cross folder clamping means includes a clamp member including a foot, a clamp element, a first drive for moving the clamp element toward the foot to clamp the lead end of the sheet material against the foot and for moving the clamp element away from the foot.

42. A machine as in claim 40 including a tuck folder located at the downstream end of the conveyor path.

43. A machine as in claim 42 wherein said tuck folder is adapted to receive a folded sheet material bundle discharged from the downstream end of the conveyor and wherein said tuck folder includes:

A) a first folded sheet transfer means;

B) a second folded sheet transfer means adjacent said first transfer means; said second transfer means for moving the sheet material away from the conveyor along with the first and in combination with the first transfer means, the first and second transfer means each having an upstream end near the conveyor downstream end, said upstream ends defining a tuck nip between said ends;

C) a tucker blade movable between a first position away from the tuck nip and a second position where the blade is located in the tuck nip; and D) a tucker blade drive operable to move the blade from the first position to the second position so that as the tucker blade moves to the second position, the blade engages the folded sheet material and moves the bundle into engagement with said first and second transfer means.

44. A machine for cross folding a length of sheet material having a lead end, said machine comprising a) a frame;

b) a sheet material conveyor on the frame, said sheet material conveyor having an upstream end, a downstream end, a conveyor path between said ends, a belt on the path and a belt drive for moving the belt toward the downstream end along the path;

c) a first sheet material cross folder on the conveying path, the folder including:

i) a clamp support located above the conveyor path, ii) a clamp on the clamp support for clamping the lead end of a length of sheet material moving along the conveyor path toward the downstream end of the conveyor, the clamp being movable downstream from a first position located under the support and on the conveying path to a second position located downstream from the first position and above the conveyor path, and iii) a drive for moving the clamp from the first position downstream and then above and away from the conveyor path to the second position, and d) a second sheet material cross folder located on the conveyor path downstream from the first sheet material cross folder, said second sheet material cross folder including a fold guide located immediately upstream of the second sheet material cross folder and spaced a distance above the belt for reducing the height of a lead fold formed in the sheet material as the lead fold is moved into second sheet material cross folder.

45. A machine as in claim 44 including a third sheet material cross folder, said third cross folder located on the path of the conveyor, said first sheet folder being located upstream of the second sheet folder and said second sheet folder being located upstream of said third sheet folder, said third folder including a fold guide located immediately upstream of the third sheet material cross folder and spaced a distance above the belt for reducing the height of a second lead fold formed in the sheet material by the second cross folder as the second lead fold is moved into the third sheet material cross folder.

* * * * *

UNITED STATES PATENT AND TRADEMARK OFFICE

CERTIFICATE OF CORRECTION

PATENT NO. : 5,634,875

DATED : June 3, 1997

INVENTOR(S) : Dwight R. Fisk

David A. Schmidt

It is certified that error appears in the above-identified patent and that said Letters Patent is hereby corrected as shown below:

Column 1, line 27, following "material to" insert--pass--.
Column 6, line 49, change "SO" to "50".
Claim 5, line 4, change "conveying" to --conveyor--.
Claim 23, line 2, change "strip" to --sheet--.
Claim 24, line 2, change "strip" to --sheet--.

Signed and Sealed this

Twenty-eighth Day of April, 1998

Bruce Lehman

*Attest:*

BRUCE LEHMAN

*Commissioner of Patents and Trademarks*

*Attesting Officer*